United States Patent [19]

Kolbe et al.

[11] Patent Number: 4,863,478

[45] Date of Patent: Sep. 5, 1989

[54] DRESSING AGENT FOR SYNTHETIC FIBERS

[75] Inventors: Joachim Kolbe; Ferdinand Kümmeler, both of Leverkusen; Ralf Miessen; Rudolf-Jürgen Klee, both of Dormagen, all of Fed. Rep. of Germany

[73] Assignee: Bayer Aktiengesellschaft, Leverkusen, Fed. Rep. of Germany

[21] Appl. No.: 190,203

[22] Filed: May 4, 1988

[30] Foreign Application Priority Data

May 23, 1987 [DE] Fed. Rep. of Germany ..... 3717454

[51] Int. Cl.[4] ..... D06M 13/00

[52] U.S. Cl. ..... 8/115.6; 252/86; 8/115.54

[58] Field of Search ..... 8/115.6, 115.54; 252/8.6; 428/374, 394, 395

[56] References Cited

U.S. PATENT DOCUMENTS 3,434,878 3/1969 Proffitt, Jr. ..... 428/374
4,095,941 6/1978 Cuntze et al. ..... 8/551

FOREIGN PATENT DOCUMENTS 3325228 1/1985 Fed. Rep. of Germany .

*Primary Examiner*—Paul Lieberman
*Assistant Examiner*—John F. McNally
*Attorney, Agent, or Firm*—Sprung Horn Kramer & Woods

[57] ABSTRACT

Improved dressings for synthetic fibers, especially acrylonitrile fibers, comprise an anion-active preparation, a polyethylene dispersion and a dicarboxylic acid semiester salt.

6 Claims, No Drawings

DRESSING AGENT FOR SYNTHETIC FIBERS

This invention relates to new dressings for synthetic fibers (textile fiber preparations) produced by the dry spinning process, especially polyacrylonitrile fibers, and in particular those which are worked up by the breaker cable process.

It is known to treat synthetic fibers with dressings after they have been stretched with a view to obtaining optimum anti friction properties and sufficient surface conductivity for the subsequent processing steps. These considerations also apply to filaments which are worked up by the so called breaker cable process in which the endless filaments present in cables are broken up into segments of a pre-determined length by over stretching them between pairs of rollers rotating at different speeds.

The friction and gliding properties required of the individual fibers in this process are not the same as those required, for example, in the process for the production of staple fibers by cutting. When the cables are broken, the individual filaments in the various stretching zones slide over one another, and this requires special gliding properties.

The friction properties must conform to several different requirements at the same time. The adherence or gliding friction between fiber and fiber as well as between fiber and transport apparatus must be so adjusted to one another that, first, the cable can be broken without disturbances on the machine and, secondly, spinning and any subsequent twisting process required will proceed smoothly. Proper adjustment of the dressing to the surface of the fiber to produce optimum friction is particularly critical in the case of dry spun acrylic fibers. Even if the friction properties of a particular dressing can be suitably chosen so that a good quality of breaking draft as well as good running properties area obtained in the breaking process, subsequent working up of the breaking draft is in many cases not optimal. The adherence of the sliver is too low so that the machines cannot be operated at their full speeds for yarn spinning, and excessive abrasion may occur if the fiber is subsequently twisted.

The known dressings for polyacrylonitrile fibers are generally mixtures of anti-static agents and lubricants of various types. These cannot always be clearly distinguished from one another by their properties since antistatic agents may also have certain lubricating properties while lubricants frequently also contribute to the surface conductivity.

Phosphoric and sulphuric acid esters of fatty alcohols or their polyglycol ethers are suitable antistatic agents. Alkane phosphonic acid semi-esters are also suitable. The anti-static properties and lubricating properties of phosphoric acid esters and of sulphuric acid esters may be varied within certain limits by using a combination of esterification components which differ in the length of their carbon chain or their polyether chain. Alkyl polyglycol ethers, fatty acid polyglycol ethers, fatty acid alkyl ethers, polyol fatty acid esters, paraffins and polyglycols are frequently used to reinforce the lubricating properties. Thus DE-OS No. 2 518 123, for example, describes dressings for the preparation of breaker cables of polyacrylonitrile which consist of mixtures of polyglycol ethers, alkali metal salts of alkane sulphonic acids and phosphoric acid alkyl esters. Mixtures of paraffins and phosphoric acid esters are described for the same purpose in U.S. Pat. No. 3,434,874, but cation active substances are mentioned for dressing PAC cables. DE-OS No. 2 447 410 mentions condensates of fatty acids and amines, preferably obtained from amino ethyl ethanolamine, while DE No. 3 325 228 A 1 proposes esterified, alkoxylated quaternary ammonium compounds.

None of these products meet the requirements of a polacrylic fiber which has been produced by the dry spinning process and is to be worked up by the breaker cable process. Troubles arise in the breaking process, especially with types of fibers which have a low degree of matting, and very much so in glossy types of fibers.

Two troublesome phenomena are recorded. First, a poor, uneven breaking pattern characterized by well known concepts such as breaking unrest, group breaking and fish formation. The result of such a breaking pattern is generally an untidy breaking draft, i.e. one which is unevenly torn. Secondly, the gliding properties of the cable may be impaired by unsuitable dressings, e.g. due to the cable wrapping round various breaker cylinders.

It was an object of the present invention to provide improved dressings for synthetic fibers, in particular for polyacrylonitrile fibers which are to be worked up by the breaker cable process.

The present invention relates to a dressing (preparation) for synthetic fibers, especially fibers of polyacrylonitrile, which are produced by the dry spinning process and especially those which are to be worked up by the breaker cable process, characterized in that the dry residue comprises, preferably contains, (a) a polyethylene dispersion, preferably from 5 to 40% by weight thereof, (b) at least one dicarboxylic acid semi ester, preferably 5 to 40% by weight thereof, and (c) an anion-active dressing, preferably 30 to 70% thereof, which dressing preferably contains a phosphoric acid alkyl ester, in particular 60 to 80% by weight thereof, an alkyl sulphuric acid ester, in particular 0 to 40% thereof, and an alkyl polyglycol ether or acyl polyglycol ester, preferably 0 to 30% thereof.

In a preferred embodiment, the dressing contains, expressed in weight proportions of the dry residue:

45 to 50% of a phosphoric acid ester obtained from the reaction of 3 mol of hexadecyl alcoholmonoglycol ether and 1 mol of phosphorus pentoxide, neutralised with potassium hydroxide solution, 15 to 20% of commercial oleyl alcohol (iodine number: 65) +50 mol of ethylene oxide 15 to 20% of polyethylene dispersion and 15 to 25% of a dicarboxylic acid semi ester salt.

Another particularly preferred dressing is characterized in that the phosphoric acid alkyl esters are mixtures of mono- and di esters such as may be obtained by the reaction of 3 mol of alcohol or polyglycol ether or mixtures thereof with 1 mol of phosphorous pentoxide.

Another particularly preferred dressing is characterized in that the alkyl sulphuric acid esters are products of sulphation of $C_{12}$ to $C_{20}$ aliphatic alcohols or their polyglycol ethers containing ether chains of 1 to 30 glycol units, of the type of ethylene glycol or propylene glycol.

In addition to these two components, the dressings may contain the usual constituents such as anti-static agents of the type of phosphoric acid esters and/or sulphuric acid esters, polyglycols or polyglycol ethers.

The present invention further relates to a process for applying the dressings according to the invention to synthetic fibers, in particular to polyacrylonitrile fibers. The invention also relates to fibers, in particular to polyacrylonitrile fibers produced by the dry spinning process, containing a dressing according to the invention on their surface.

The polyethylene dispersions may be so called primary dispersions of the type prepared by the emulsion polymerisation of ethylene by known processes and having molecular weights of from 10,000 to 50,000, but so called secondary dispersions may also be used. The latter may be obtained by the known process of dispersing oxidized polyethylenes (so called polyethylene waxes in which carboxyl groups are formed by oxidation) or Fischer-Tropsch waxes with the aid of nonionic emulsifiers and alkalis, and may have molecular weights of from 1500 to 6000. The polyethylene dispersions used according to the invention are preferably in the aqueous phase. The polyethylenes preferably have a melting range at temperatures above 125° C.

The dicarboxylic acid semi-esters are obtained by known processes from dicarboxylic acid anhydrides and alcohols or their polyglycol ethers by the reaction of equimolar quantities at elevated temperatures followed by neutralization of the second carboxyl group with alkalis or amines.

The dicarboxylic acid anhydrides used may be maleic acid anhydride or succinic acid anhydride. If relatively high molecular weight decarboxylic acids are to be used, it is advisable to employ the process of esterification with acid catalysis in a solvent at elevated temperatures and azeotropic removal of the water split off in the reaction. Dicarboxylic acids such as adipic acid or sebacic acid may be esterified in high yield by this process.

The esterification components used may be straight chained aliphatic alcohols with one to 20 carbon atoms or branched aliphatic alcohols with 3 to 20 carbon atoms or the poly glycol ethers of such alcohols containing 1 to 20 glycol units, which are formed when these alcohols are reacted with ethylene oxide or propylene oxide.

Neutralization of the dicarboxylic acid semi esters be carried out by means of sodium or potassium hydroxide, carbonates or bicarbonates or amines, preferably alkanolamines, such as monoethanolamine, diethanolamine, triethanolamine or the corresponding homologs containing propyl or i-propyl groups.

In one particularly preferred embodiment, the dicarboxylic acid semi esters correspond to the following formula:

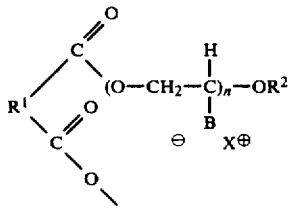

wherein $R^1$ denotes —CH=CH—, —$(CH_2)_2$—, —$(CH_2)_4$—, —$CH_2)_8$—, $R^2$ denotes $C_1$–$C_{18}$ alkyl or $C_{16}$–$C_{18}$ alkenyl, n denotes 0 to 20, B denotes H or $CH_3$ and X denotes Na, K or an ammonium salt, in particular one derived from $H_2N—CH_2—CH_2—OH$, $HN(CH_2—CH_2—OH)_2$, or $N(CH_2—CH_2—OH)_3$.

The dressings according to this invention generally contain from 5 to 40%, preferably from 10 to 25% of polyethylene dispersion and 5 to 40%, preferably from 15 to 25% of dicarboxylic acid semi ester salt, the percentages denoting proportions of the dry substance.

The dressings are generally applied at a concentration calculated to produce an application of dressing of from 0.1 to 0.5% by weight, based on the fibre material, depending on the individual titre and degree of mattness of the fibres.

The dressings may be applied by means of an immersion bath after stretching, and the moisture taken up may be regulated by partly squeezing it off before the sliver runs into the dryer and is then crimped. Other dressing techniques may also be employed, such as spraying or so called one way techniques in which the sliver is moved past a slot supplied with dressing.

Preparation of the dressing is generally carried out by simply mixing the components either at room temperature or at elevated temperature, depending on the nature of the individual components. It is advantageous to choose the proportion of active substance so that liquid products are obtained, which are easier to handle.

The dressings according to this invention are suitable for synthetic fibers, in particular polyester, polyamide or polyolefine fibers and especially polyacrylonitrile fibers, particularly those produced by the dry spinning process.

EXAMPLES

The following abbreviations are used in the examples which follow:

A 1: aqueous polyethylene dispersion having the following properties: emulsion polymerisation of ethylene in 2.5 to 3% solution of a sodium salt of alkane sulphonate; melting point of the dry residue = 150°–160° C.; 36.5% polyethylene (average molecular weight ~20,000) 2.5–3% sodium salt of alkane sulphonate, 60.7% distilled water. Density 0.97 g/cm$^3$.

A 2: aqueous dispersion of a polyethylene wax obtainable by heating 400 g of a polyethylene wax, acid number 30, density 0.99 according to ASTM D 3104-77, and drop point 137° C. according to ASTM D-3104-77

100 g of commercial lauryl alcohol + 10 mol of ethylene oxide 17 g of 50% potassium hydroxide solution and 1518 g of completely desalted water to 150° C. in a closed autoclave with stirring.

After 30 minutes, the reaction mixture is rapidly cooled to 60° C. and removed from the autoclave. A stable opaque dispersion has formed.

D: mixture of 80% straight chained $C_{12}$–$C_{13}$ primary alcohols and 20% 2-methyl isomers.

EO: ethylene oxide

MSA: maleic acid anhydride

BSA: succinic acid anhydride.

PREPARATION OF THE DICARBOXYLIC ACID SEMI ESTER SALTS.

General method of preparation:

1.0 mol of the dicarboxylic acid anhydride is added portionwise with stirring to 1.0 mol of an aliphatic alcohol or its polyglycol ether at 80° to 90° C. and the reaction mixture is kept at 80° to 90° C. for two hours. The reaction has by then been completed virtually quantitatively, as can be ascertained from the acid number.

After cooling, the product is adjusted to a concentration of 25% by the addition of water and neutralized with an alkali or amine.

The following dicarboxylic acid semi ester salts are prepared by this method:

| | Dicarboxylic acid anhydride | Ester component | | Acid Number | Cation |
|---|---|---|---|---|---|
| B 1 | MSA | D | +10 mol EO | 77 | diethanolamin |
| B 2 | MSA | D | +4 mol EO | | potassium |
| B 3 | MSA | n-butanol | +12 mol EO | 81 | sodium |
| B 4 | BSA | 2-ethylhexanol-1 | +4 mol EO | 140 | potassium |
| B 5 | BSA | methanol | +10 mol EO | 99 | sodium |

The aqueous products adjusted to a concentration of 25% are clear solutions.

The anion active dressings were prepared as follows:

C1: a mixture consisting of 17.5% of a phosphoric acid ester obtained from the reaction of 2 mol of octadecyl alcohol, 1 mol of D +10 mol of EO and 1 mol of phophorous pentoxide, neutralized with diethanolamine, 7.5% of the sulphuric acid ester of a commercial lauryl alcohol +30 mol EO, neutralized with sodium hydroxide solution and 75.00% of completely desalted water.

C2: a mixture consisting of 18.75% of a phosphoric acid ester obtained from the reaction of 3 mol of hexadecyl alcohol monoglycol ether and 1 mol of phosphorous pentoxide, neutralized with potassium hydroxide solution, 6.25% of commercial oleyl alcohol (acid number: 65) +50 mol EO and 75.00% completely desalted water.

TEST METHOD

The following tests were carried out to assess the suitability of the dressings:

1. breaking of a standard cable of 100 ktex on a Seydel breaking machine 671 S, assessment (a) of a breaking pattern and (b) of the running properties.

The breaking pattern is characterized in terms of the "breaking unrest" as well as the "group breaking intensity" (strands breaking off) and is assessed in the breaking zone between the heads 4 and 5. The assessment is made by giving marks 3 . . . 9 where 3= good breaking pattern, 9= extremely poor breaking pattern. The mark 5 corresponds to a breaking pattern which is still acceptable. The breaking pattern is in addition described by the so called "fish formation", in particular in the last breaking zone. Poor marks (>5) for Fisch formation indicate uneven breaking drafts, i.e. an unusuable quality of breaking draft, while poor marks for breaking unrest and group breaks without unsatisfactory "fish formation", merely indicate a risk of poor quality of breaking draft.

The running properties are characterized in particular by the formation of coils. If coil formation is recorded within the given test periods of 10 minutes, then the dressing is unsuitable even if the breaking pattern is excellent.

It should be noted that all the tests are carried out both for a cold breaking process and for hot breaking (130° C.). The breaking pattern and running properties must be satisfactory under both breaking conditions.

2. The breaking drafts are spun out. For this process it is important inter alia to assess the adherence of the sliver. This may be assessed, for example, by measuring the filling height of the can (filling level) above the edge of the can for a given can filling. Even slightly raised filling heights indicate insufficient operational reliability for spinning. We assessed those cans which were submitted to the finisher.

3. Assessment of abrasion in double two-for-one twisting machine.

The quantity of deposits formed after two drafts from a Volkmann-DD machine was assessed.

EXAMPLES OF DRESSINGS

| Example | Composition of Dressing c | a | b |
|---|---|---|---|
| D 1 | 100% C 2 | | |
| D 2 | 80% C 2 | 20% A 1 | |
| D 3 | 64% C 2 | 16% A 1 | 20% B 1 |
| D 4 | 64% C 2 | 16% A 1 | 20% B 3 |
| D 5 | 100% C 1 | | |
| D 6 | 80% C 1 | 20% A 1 | |
| D 7 | 70% C 1 | 30% A 1 | |
| D 8 | 70% C 1 | 30% A 2 | |

Solutions at concentrations of 4 to 16 g/l were prepared from the given mixtures and applied from each immersion bath to polyacrylonitrile cables of 50 to 150 ktex at a bath temperature of 80° C. After the cables had been squeezed off to a residual moisture content of 30 to 50%, they were passed through a screen drum dryer and crimped.

Dressing (D 1) was applied at concentrations of 0.21 to 0.27% and tested for the response under breaking conditions. The marks given for breaking were still within an acceptable range both for hot breaking and for cold breaking but the running properties were unsatisfactory. In the cold breaking test, on average two coils were formed within 10 minutes, regardless of the concentration.

Dressing (D 2), was applied at concentrations of 0.10 to 0.41%. Dressing was carried out under production conditions by immersion finishing of the cable in an aqueous solution heated to 80° C. (5.5 to 14.4 g/l dressing) followed by squeezing off and then drying and crimping of the cable. The breaking properties were determined as follows: The breaking quality was satisfactory when the dressing was applied in quantities of from 0.15 to 0.30%. The marks given for group breaking and unrest were on average 4. Outliers above 5 were not recorded. The marks for fish formation were in fact mainly 3. The quality of the combed sliver was therefore good.

The running properties were satisfactory except in those samples which had a low application of dressing of 0.1% (coil formation due to charging occured at 0.1%). No coil formation was recorded when 0.15 to 0.41% dressings were applied.

On further processing of these samples it was found, however, that the degree of filling of the cans submitted to the finisher were notably higher. The filling levels of the cans were about 30% higher than is customary with batches which spin well. The drawing frame slivers were too bulky. When they were worked up in the finisher, broken slivers heaped up when the supply cans were almost empty. (Cans without spring plates).

When the yarns were twisted, only very slight deposits were found on the twisting machine. The twisting process was entirely satisfactory. Dressing (D 3) was applied to polyacrylonitrile cables as previously described. The breaking properties were satisfactory at concentrations of from 0.21 to 0.41%. The mark given for fish formation, for example, was in all cases 3. The running properties were also entirely satisfactory. No coiling was found in any of the cases.

In subsequent processing stages, improved adherance of the sliver was found, at least when dressings in the range of 0.21 to 0.32% were applied. The filling levels in the cans were comparatively low, as in known batches which spin well. The slivers could be processed in the finisher without any heaping up of broken slivers. No significant deposition of dust was found in the process of twisting the yarns.

When a different bonding component was used (dressing D 4), the breaking pattern was satisfactory at dressing applications of from 0.17 to 0.25%.

Experiments were also carried out with dressings based on dressing preparation C 1 instead of dressing preparation C 2. The following combinations were tested:

1. Dressing example D 6
2. Dressing example D 7
3. Dressing example D 8.

The applications of dressing varied from 0.12 to 0.26%. No coil formation could be found in any of the cases and the running properties were entirely satisfactory.

The breaking pattern was also satisfactory; the marks for fish formation, for example, ranged from 3 to 4. When no (b) was added, however, the problem of poor adherence of the drawing frame slivers remained.

We claim:

1. A finishing agent for synthetic fibers comprising, based on a dry residue, (a) 5 to 40% of a polyethylene dispersion, said polyethylene dispersion is a primary dispersion having a molecular weight of from 10,000 to 50,000 or a secondary dispersion prepared from an oxidized polyethylene or a Fischer Tropsch wax, a nonionic emulsifier and alkali, (b) 5 to 40% of a dicarboxylic acid semi ester salt, said dicarboxylic acid semi ester salt having the following formula

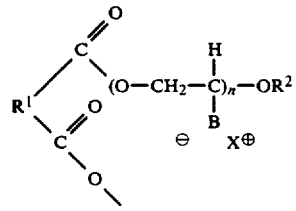

wherein $R^1$ denotes —CH—CH—, —$(CH_2)$,—$(CH_2)_4$—, or —$(CH_2)_8$—, $R^2$ denotes $C_1$-$C_{18}$ alkyl or $C_{16}$-$C_{18}$ alkenyl, n denotes 0 to 20, B denotes H or $CH_3$, and X denotes Na, K or an ammonium ion and (c) 30 to 70% of an anion active dressing selected from the group consisting of an acid alkyl ester, an alkyl sulphuric acid ester, an alkyl polyglycol ether and an acyl polyglycol ester.

2. A process for dressing a synthetic fiber comprising applying a finishing agent according to claim 1 to a synthetic fiber, said agent being applied by immersion or spraying in a quantity of 0.1 to 0.5% by weight before drying and crimping.

3. A process according to claim 1, wherein the fiber is a polyacrylonitrile fiber.

4. A finishing agent according to claim 1 containing 10 to 25% of the polyethylene dispersion and 15 to 25% of the dicarboxylic acid semi ester salt.

5. Synthetic fibers having a finishing agent applied thereon, wherein the finishing agent is according to claim 1.

6. Fibers according to claim 5, wherein the fibers are polyacrylonitrile fibers.

* * * * *